US007325759B2

(12) United States Patent
Meyer

(10) Patent No.: US 7,325,759 B2
(45) Date of Patent: Feb. 5, 2008

(54) METHOD FOR MINIMIZING DAMAGE TO A WASTE FRAGMENTATION MACHINE

(75) Inventor: Douglas G. Meyer, Clearwater, MN (US)

(73) Assignee: Rotochopper, Inc., St. Martin, MN (US)

( * ) Notice: Subject to any disclaimer, the term of this patent is extended or adjusted under 35 U.S.C. 154(b) by 230 days.

(21) Appl. No.: 11/138,101

(22) Filed: May 26, 2005

(65) Prior Publication Data

US 2006/0266855 A1 Nov. 30, 2006

(51) Int. Cl.
*B02C 25/00* (2006.01)

(52) U.S. Cl. ..... 241/30; 241/34; 241/36

(58) Field of Classification Search ..... 241/30, 241/33–37, 101.2
See application file for complete search history.

(56) References Cited

U.S. PATENT DOCUMENTS 4,560,110 A 12/1985 Burda
6,714,880 B2 3/2004 Carle et al.
2003/0178515 A1* 9/2003 Boerhout et al. ..... 241/30

* cited by examiner

*Primary Examiner*—Mark Rosenbaum
(74) *Attorney, Agent, or Firm*—Altera Law Group, LLC

(57) ABSTRACT

A method for reducing impact damage to a waste fragmentation machine is provided in various embodiments. In general, material that is potentially ungrindable, e.g., unacceptably dense, may be inadvertently allowed to enter into the grinding chamber within the machine where it encounters a high-speed rotor. The high-speed rotor comprises rotor teeth that impact the material to fragment or comminute it to an acceptable size. A vibration detector is placed in proximity with the rotor's bearing(s) and, after taking a daily baseline sample, monitors the fragmentation process. If the vibration level goes beyond an alert upper limit, the operator may be alerted via visual and/or audible annunciation that potentially ungrindable material may be in the grinding or fragmenting chamber. The operator may then examine the waste material and, if necessary, remove any potentially ungrindable material. Further, if the vibration level exceeds an interventional upper limit, in various embodiments the powered feed system that feeds the waste material into the grinding chamber may be stopped. Alternatively, the feed system may be reversed and/or the high-speed rotor may be disengaged. In certain embodiments, if the interventional upper limit has been exceeded, the machine may require the operator to actively intervene, e.g., entering a password, before the machine will resume fragmenting.

24 Claims, 5 Drawing Sheets

METHOD FOR MINIMIZING DAMAGE TO A WASTE FRAGMENTATION MACHINE

FIELD OF THE INVENTION

This invention relates generally to a method for monitoring and analyzing the processes occurring during operation of a waste fragmentation machine to minimize damage.

BACKGROUND OF THE PRESENT INVENTION

Fragmenting machines or waste recycling machines are designed to splinter and fragment wastes under tremendous impacting forces. Operationally, waste materials are fed to a fragmenting zone or grinding chamber by power feeding means. Once the waste materials are within the fragmenting zone or grinding chamber, a powered fragmenting rotor that is rotating at high speed and comprising impacting and shearing teeth is encountered. The resulting impact results in the fragmentation and/or comminution of the waste materials to a desired particle size. Generally, the rotor rotates at about 1800-2500 r.p.m. Thus, a tremendous force is generated at the point of impact between the waste material and the impacting rotor teeth. Certain material having unacceptably high density, e.g., heavy pieces of steel, are ungrindable and may cause significant damage to the fragmenting machine, resulting in expense and machine downtime. Thus, a need exists for detecting the potentially damaging material and for preventing or minimizing such damage upon detection.

A wide range of methods and associated devices are currently used for monitoring performance characteristics of industrial equipment. Generally, the monitoring devices generally are placed on, or near, the equipment or points of interest thereof. Once positioned, the devices monitor certain signals generated by the equipment and the performance of the equipment is then evaluated by, inter alia, analyzing the signal data. These signals are utilized to monitor the performance of the equipment over its operating life. For example, vibration monitoring may be used to monitor the frictional energy created by the equipment's moving parts, e.g., bearings, couplings, gear mesh and the like. Low frequency vibration measurements may indicate a bearing in an advanced state of wear and potentially provide information about the root cause of the failure such as misalignment, imbalance, etc. High frequency vibration monitoring may detect such wear at an earlier stage, triggering alarms before the bearing enters a failure state due to wear and tear. High frequency vibration monitoring may also allow for maximization of preventive maintenance programs by indicating when, for example, it is necessary or desirable to grease or otherwise lubricate the subject machine components.

However, none of the currently described methods allow for detection of potentially ungrindable material within the grinding or fragmenting chamber of a waste fragmenting machine. Nor does any currently known waste fragmenting machine combine detection of potentially ungrindable material with additional steps to minimize any damage resulting from the impact of the rotor teeth on the potentially ungrindable material.

Accordingly, there remains a need for a method that limits or prevents damage to a fragmenting machine by detecting unacceptably dense material within the grinding chamber or fragmenting zone and then initiating steps to minimize any damage. The present invention addresses this need.

SUMMARY OF THE INVENTION

A method for reducing impact damage to a waste fragmentation machine is provided in various embodiments. In general, material that is potentially ungrindable, e.g., unacceptably dense, may inadvertently enter the grinding or fragmenting chamber within the machine where it encounters a high-speed rotor. The high-speed rotor comprises rotor teeth that impact the material to fragment or comminute it to an acceptable size. A vibration detector is mounted near the grinding chamber and, after taking a daily baseline sample, monitors the fragmentation process. If the vibration level goes beyond an alert upper limit, the operator may be alerted via visual and/or audible annunciation that potentially ungrindable material may be in the grinding or fragmenting chamber. The operator may elect to examine the waste material and, if necessary, remove any potentially ungrindable material. Further, if the vibration level exceeds an interventional upper limit, in various embodiments the powered feed system that feeds the waste material into the grinding chamber may be stopped. Alternatively, the feed system may be reversed and/or the high-speed rotor may be disengaged. In certain embodiments, if the interventional upper limit has been exceeded, the machine may require the operator to actively intervene, e.g., entering a password, before the machine will resume fragmenting.

An object of various embodiments of the invention is to provide a method for detecting potentially ungrindable material within the fragmenting chamber of a waste fragmentation machine.

Another object of various embodiments of the invention is to provide a method for minimizing damage resulting from detected potentially ungrindable material within the fragmenting chamber of a waste fragmentation machine.

Another object of various embodiments of the invention is to provide a method for monitoring vibration levels to detect potentially ungrindable material within the fragmenting chamber of a waste fragmenting machine and subsequent intervention.

Still another object of various embodiments of the invention is to provide a method for disengaging the powered feed system when potentially ungrindable material is detected.

Yet another object of various embodiments of the invention is to a method for reversing the powered feed system when potentially ungrindable material is detected.

Another object of various embodiments of the invention is to provide a method for disengaging the fragmenting rotor when potentially ungrindable material is detected.

Another object of various embodiments of the invention is to provide a method for alerting the operator via visual and/or audible annunciation of the presence of potentially ungrindable material within the fragmenting chamber of a waste fragmenting machine.

Yet another object of various embodiments of the invention is to provide a method for locking out all control systems until the operator intervenes, e.g., enters the correct password to restart the machine when potentially ungrindable material is detected within the fragmenting chamber of a waste fragmentation machine.

The foregoing objects of various embodiments of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

With reference to the accompanying figures, there is provided a method for monitoring the density of the waste material stream entering the grinding chamber of a waste fragmentation machine to minimize machine damage cause by material of unacceptably high density.

Figure 1:
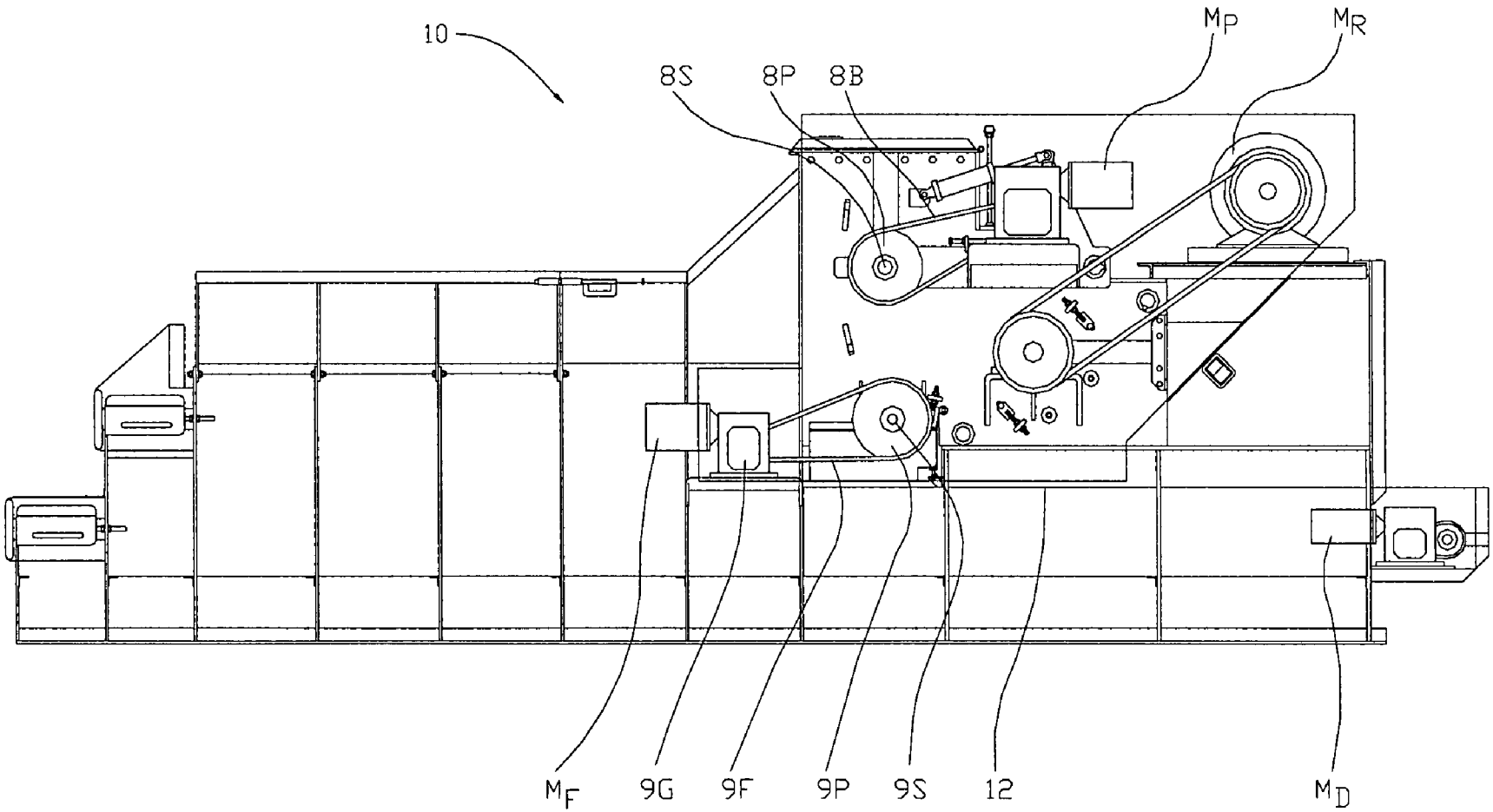
FIG. 1 is a cross-sectional view of a waste fragmentation machine.
Figure 2:
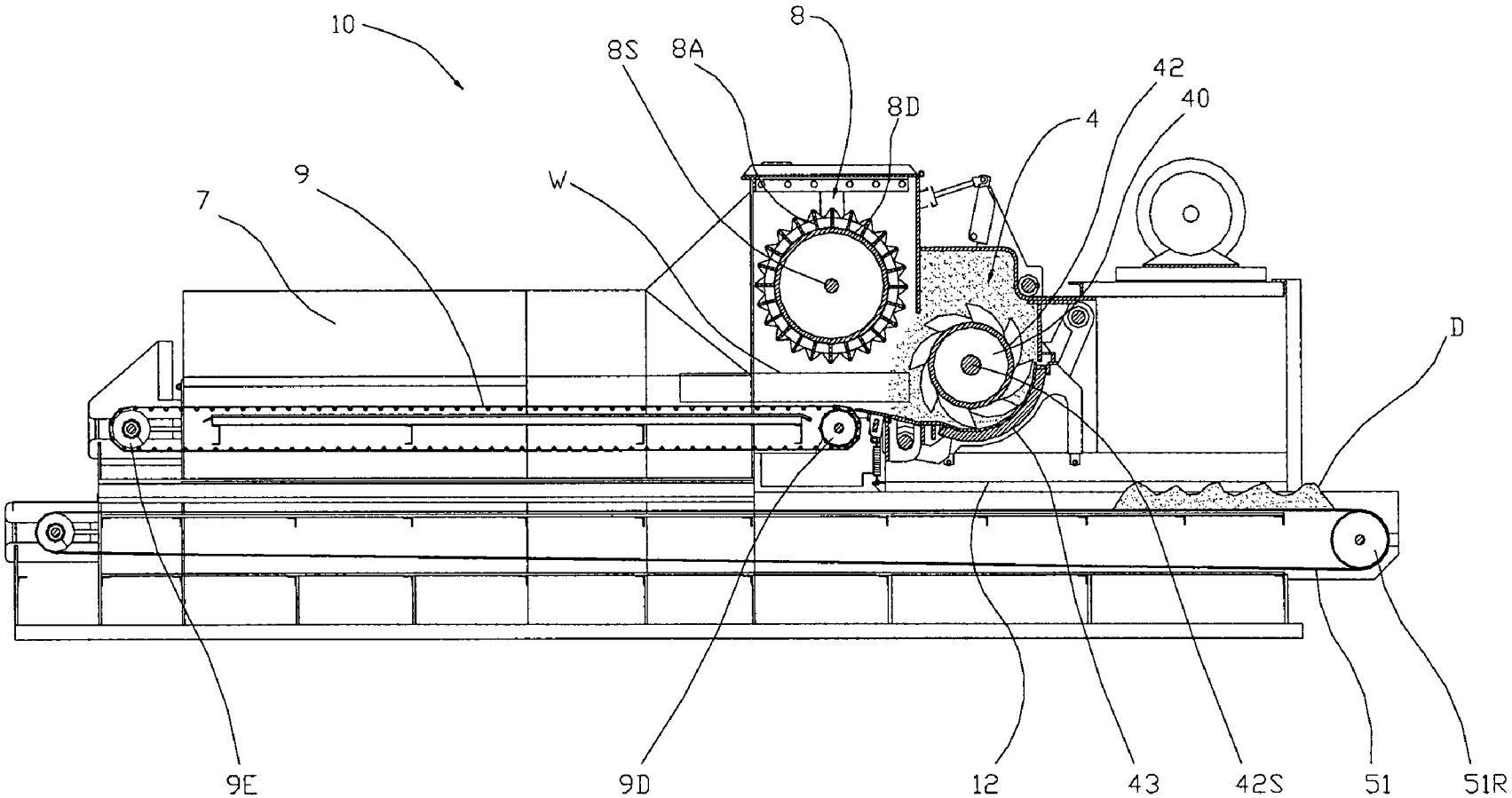
FIG. 2 is a cross sectional view of a waste fragmentation machine.

FIGS. 1 and 2 provide complementary cross-sectional views of one embodiment of a waste fragmenting machine 10. The machine 10 is designed to splinter and fragment wastes under tremendous impacting forces. Such machine may include a frame 12 structurally sufficient to withstand the vigorous mechanical workings of machine 10. One embodiment of the machine 10 may be powered by several electrical motors generally prefixed by M, namely $M_R$, $M_D$, $M_P$, and $M_F$. These electric motors are illustrated as equipped with suitable drive means for powering the various working components, namely the feeding, fragmenting and discharging means of machine 10. It will be obvious to the skilled artisan, however, that the machine 10 may be powered by a variety of different power sources, e.g., internal combustion engines, diesel engines, hydraulic motors, industrial and tractor driven power take-off, etc.

In basic operational use in various embodiments, waste materials W may be power fed by a conveyer system to a fragmenting or grinding chamber 4 by a powered feed system 8 powered by a feed motor $M_F$ in cooperative association with a power feed rotor drum 8D powered by power feed motor $M_P$.

Thus, one embodiment of the machine 10 may include a hopper 7 for receiving waste materials W and a continuously moving infeed conveyer 9 for feeding wastes W to the waste fragmenting or grinding chamber 4. An infeed conveyer 9 may be suitably constructed of rigid apron sections hinged together and continuously driven about drive pulley 9D and an idler pulley 9E disposed at an opposing end of the conveyer 9. The conveyer 9 may be operated at an apron speed of about 10 to about 30 feet per minute, depending upon the type of waste material W. The travel rate or speed of infeed conveyer 9 may be appropriately regulated through control of gearbox 9G. Feed motor $M_F$ in cooperative association with gear box 9G, apron drive pulley 9P, chain 9F, and apron drive sprocket 9D driven about feed shaft 9S serves to drive continuous infeed conveyer 9 about feed drive pulley 9D and idler pulley 9E.

A power feed system 8 driven by motor $M_P$ and in cooperative association with the infeed conveyer 9, driven by motor $M_F$, uniformly feeds and distributes bulk wastes W such as cellulose-based materials to the fragmenting or grinding chamber 100. Power feed system 8 positions and aligns the waste W for effective fragmentation by the fragmenting rotor 40. The power feed system 8 comprises, in one embodiment, a rotor drum 8D equipped with projecting feeding teeth 8A positioned for counterclockwise rotational movement about rotor drum 8D. Drum 8D may be driven by power feed shaft 8S which in turn is driven by chain 8B, drive sprocket 8P and motor $M_P$.

A rotary motor $M_R$ serves as a power source for powering a fragmenting rotor 40 that operates within the fragmenting or grinding chamber 4. The fragmenting and grinding are accomplished, in part, by shearing or breaking teeth 41 which rotate about a cylindrical drum 42 and exert a downwardly and radially outward, pulling and shearing action upon the waste material W as it is fed onto a striking bar 33 and sheared thereupon by the teeth 41. The shearing teeth 41 project generally outwardly from a cylindrical rotor 42, which is typically rotated at an operational speed of about 1800-2500 r.p.m. The fragmenting rotor 40 is driven about a power shaft 42S, which is in turn powered by a suitable power source such as motor $M_R$. Motor $M_R$ is drivingly connected to power shaft pulley 42P which drivingly rotates power shaft 42S within power shaft bearing 42B. The rotating teeth 41 thus create a turbulent flow of the fragmenting wastes W within the fragmenting zone 4.

Initial fragmentation and impregnation of the waste feed W is, in one embodiment, accomplished within the dynamics of a fragmenting or grinding chamber 4 which may comprise a striking bar 33 and a cylindrical rotor 42 equipped with a dynamically balanced arrangement of the shearing or breaker teeth 41. The striking bar 33 serves as a supportive anvil for shearing waste material W fed to the fragmenting zone 4. Teeth 41 are staggered upon rotor 42 and dynamically balanced. Rotor 42, generally operated at an operational rotational speed of about 1800-2500 r.p.m., rotates about shaft 42S. Material fragmented by the impacting teeth 41 is then radially propelled along the curvature of the screen 43. Screen 43, in cooperation with the impacting teeth 41, serves to further fragment by grating the waste materials W upon the surface and screen of 43 refine the waste W into a desired particle screening size until ultimately fragmented to a sufficient particle size so as to screen through screen 43 for collection and discharge by discharging conveyor 51. A discharging motor $M_D$ serves as a power source for powering a discharging means 300 that conveys processed products D from the machine 10.

Tremendous forces are thus generated within the fragmenting or grinding chamber 100 as the shearing or breaker teeth 41 impact with high rotational velocity against the waste W. If waste W is unacceptably dense, as the teeth 41 impact the waste W, damage may be done to the machine 10. Such damage may include, inter alia, breakage of teeth 41, damage to fragmenting rotor shaft, fragmenting rotor bearing and the like. It would be highly desirable to have a method for identifying waste W that is essentially ungrindable or too dense to grind without damage to the machine 10.

Figure 3A:
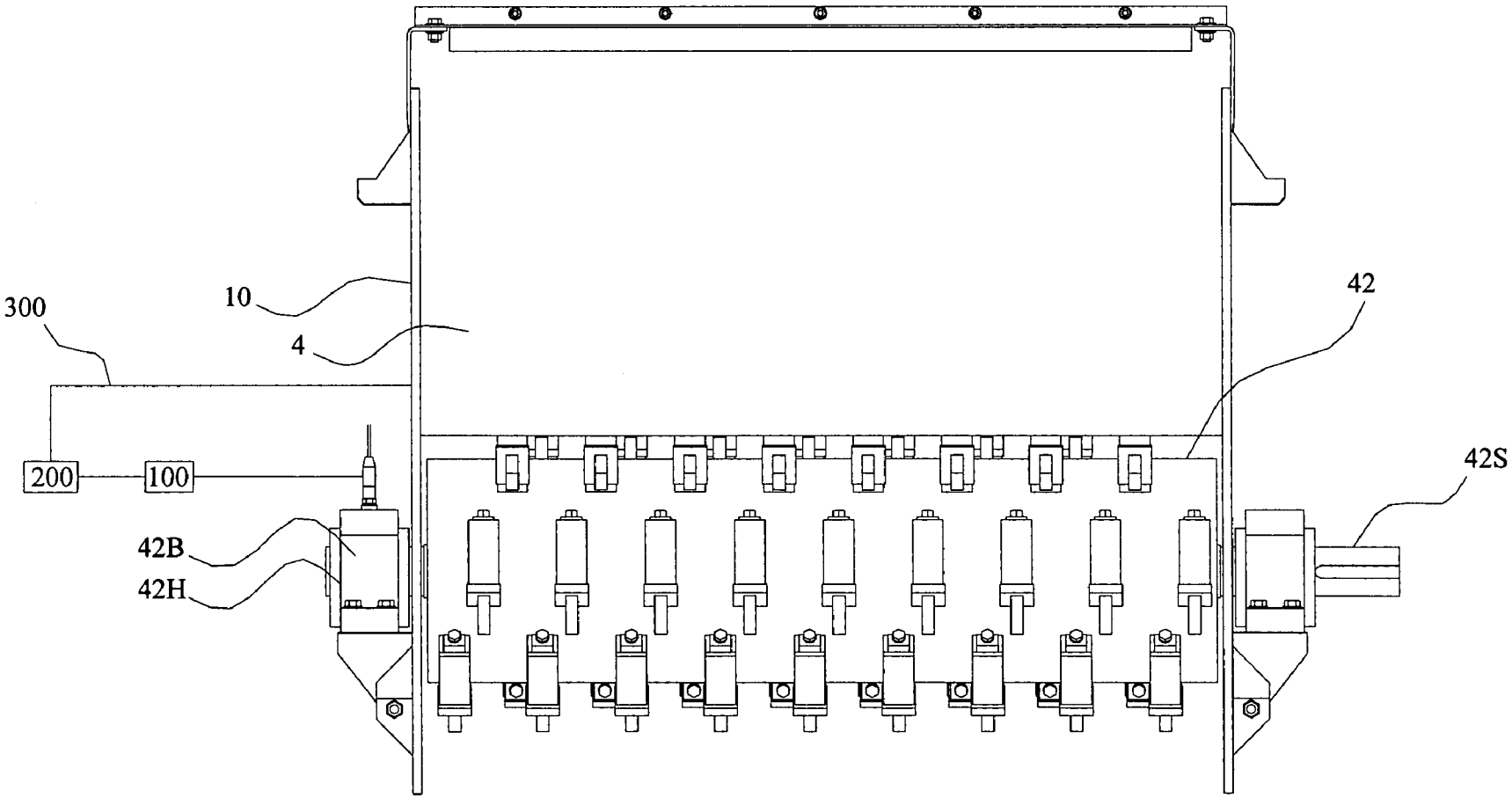
FIG. 3*a* is a breakaway of one embodiment of the apparatus used in the inventive method.
Figure 3B:
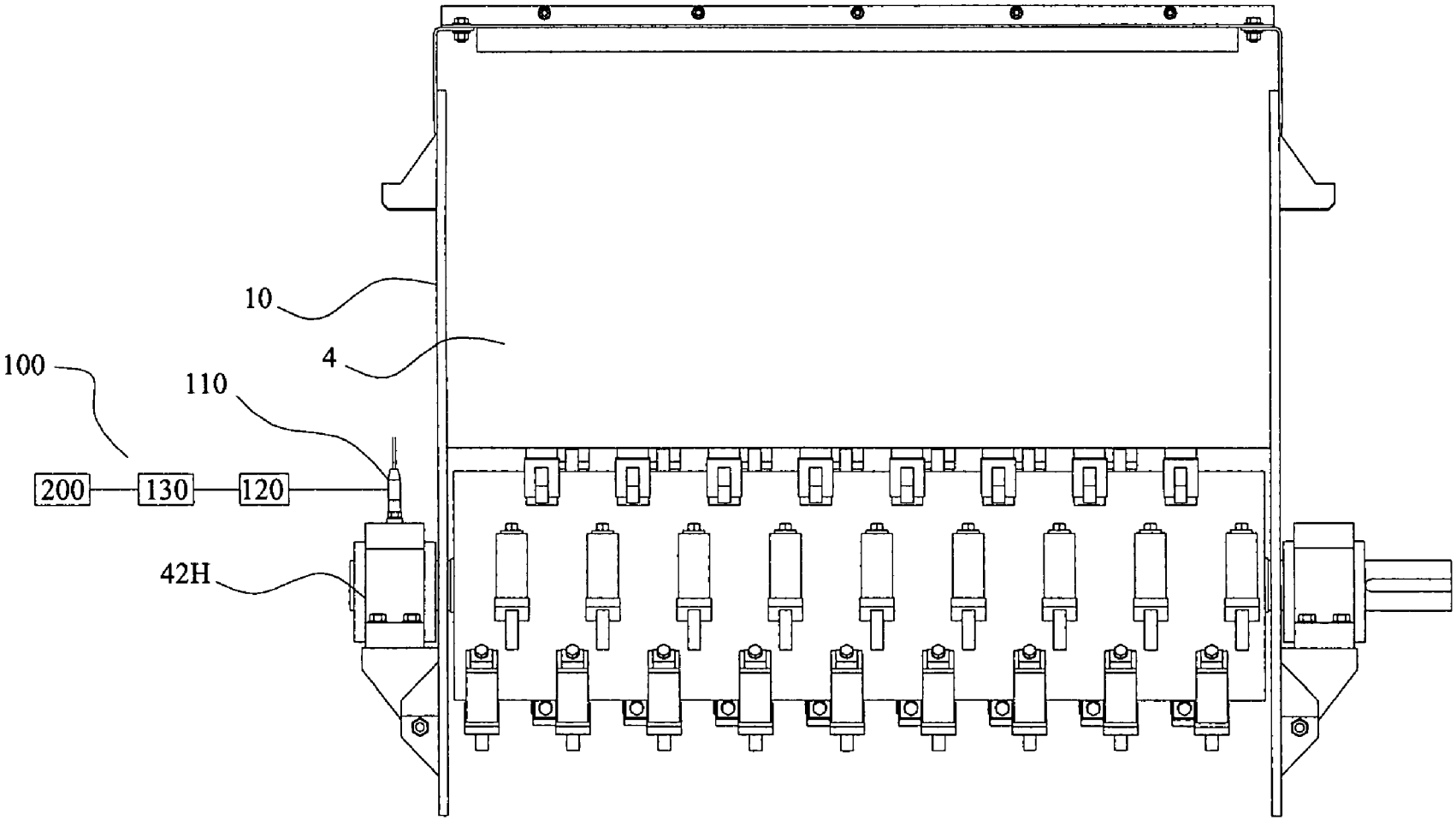
FIG. 3*b* is a block diagram of one embodiment of the apparatus used in the inventive method.

FIGS. 3*a* and 3*b* provide basic block diagrams of one embodiment of the apparatus used to practice the inventive method. The fragmentation machine is represented generally by line 10 in FIG. 3*a*. The fragmenting or grinding chamber 4 is illustrated, with the power shaft 42S shown in rotating communication with power shaft bearing 42B. Power shaft bearing 42B is shown as generally enclosed within power shaft bearing housing 42H. The vibration detection assembly 100 is shown as communicating in this embodiment with the bearing housing 42H, located adjacent the fragmenting chamber 4, though other mounting locations for the assembly 100 may readily present themselves to those skilled in the art. The assembly 100 may be in wired or wireless communication with an operator interface system 200.

The operator interface system 200 may comprise a display screen and data entry means, e.g., a keyboard or the equivalent, well known data display and entry mechanisms not shown in the figures. The operator interface system 200 may thus allow the operator to send and/or receive data from the vibration detection assembly 100 using wired or wireless communication mechanisms well known to those skilled in the art. The operator interface system 200 may also communicate with various components and/or systems within machine 10 via communication means 300.

The operator interface system 200 may further comprise at least one warning annunciator that may be actuated when potentially ungrindable material is detected by the inventive method. The warning annunciator(s) may be either audio or visual warning mechanisms. For example, warning lights may be incorporated into the operator interface system 200. The operator interface system 200 may further display a fault and/or warning message on the display. Finally, the operator interface system may incorporate or actuate a warning siren in response to the detection of potentially ungrindable waste material in the fragmenting chamber.

Communication means 300 may comprise at least one data transfer line in addition to a variety of alternative communication mechanisms and methods including, e.g., wireless communication means. Communication means 300 comprises, inter alia, the means by which the vibration detection assembly 100 may respond to a detected vibration level that is above a pre-set alert of interventional upper limit. By way of example, communication means 300 may communicate with the motors $M_P$, $M_R$, $M_D$, and/or $M_F$ to shut down or disengage one or more of the motors in response to a vibration level that exceeds pre-set levels, thus indicating the presence of potentially ungrindable material within the fragmenting chamber. In the embodiment shown in FIG. 3*a,* the operator may also utilize communication means 300 to send data and/or commands to various machine components and/or systems.

Alternatively, the vibration detection assembly 100 may respond via direct communication with certain machine components and/or systems in various embodiments that may not include an operator interface system 200. Such alternative communication may occur using wired and/or wireless communication means.

FIG. 3*b* illustrates a preferred embodiment of the vibration detection assembly 100 in greater detail. The assembly 100 may comprise a vibration detector 110 shown attached to the power shaft bearing housing 42H, a transceiver 120 for receiving the vibration signals from the detector 110, converting the signals into a digital signal and transmitting the digital signals to a processor or controller, e.g., a programmable logic controller 130 that is capable of reading and evaluating the digital vibration signals. The vibration detector 110 may preferably be an accelerometer, a device well known in the art to detect vibration levels. Other vibration detection mechanisms exist in the art and may be readily adaptable to the present invention.

The vibration detector 110 may be placed in a variety of locations on, or in, the waste fragmentation machine. A preferred location for the vibration detector 110 is adjacent the fragmenting chamber 4, e.g., attached to the bearing housing 42H. It is understood that the vibration assembly 100 may be designed to be a kit, retrofitted to existing waste fragmenting machines. Alternatively, the vibration assembly 100 may be integrated into the manufacture of a waste fragmentation machine. Further, the operator interface system 200 may be retrofitted to a machine and/or the assembly 100, or manufactured as integrated with the machine and/or assembly 100.

The apparatus relating to the inventive method having been described in certain embodiments, various embodiments of an operational method thereof will now be discussed. It will be understood that the order of the steps described herein may be arranged in a variety of ways and still achieve the inventive objects. Thus, the invention is not limited to the exemplary ordering described herein.

Figure 4:
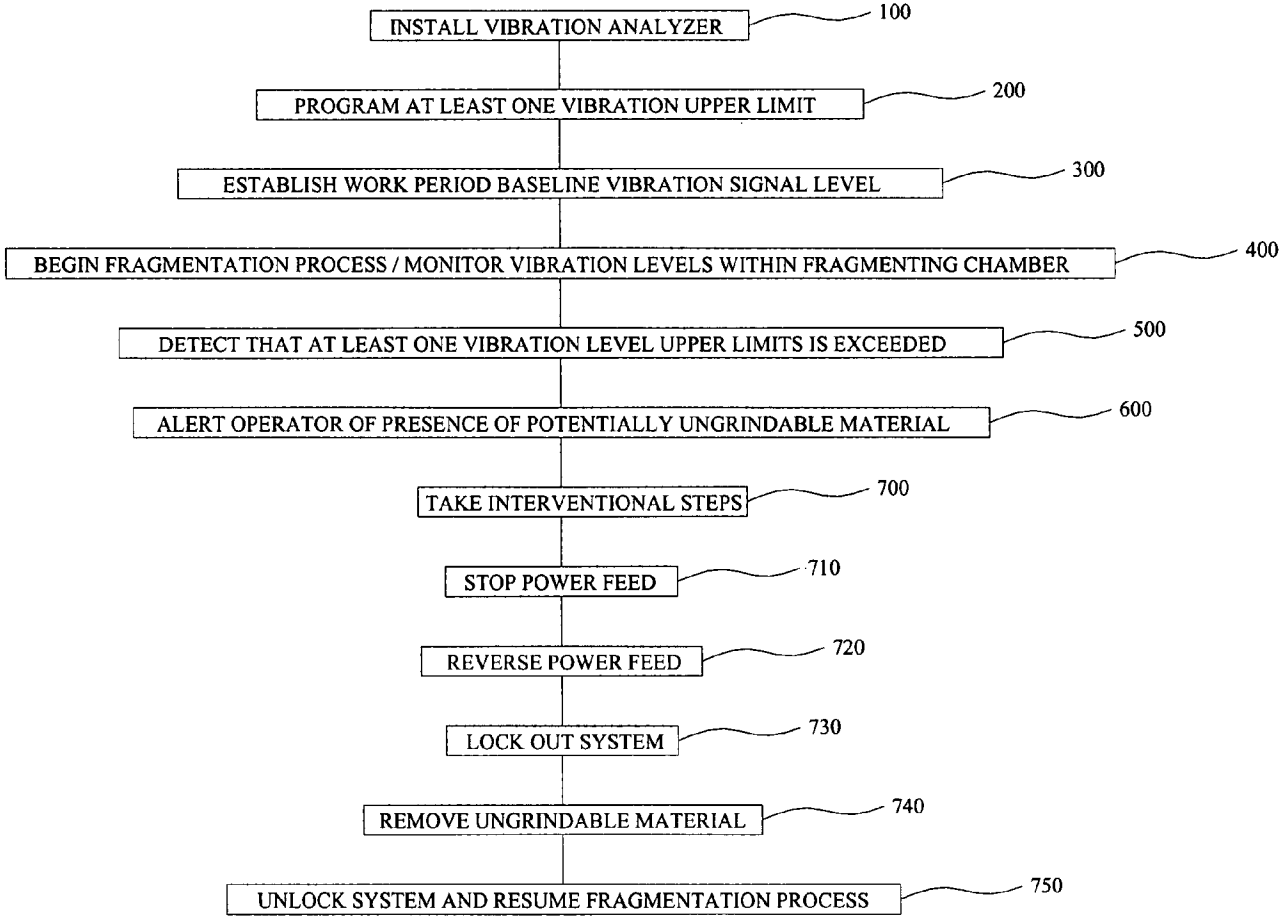
FIG. 4 is a flowchart illustrating one embodiment of the inventive method.

With specific reference now to FIG. 4, and as discussed above, the vibration analyzer apparatus, e.g., vibration assembly, operator interface system and supporting communication means, may be installed in several ways. The apparatus may either retrofitted to an existing waste fragmentation machine or manufactured as an integrated component to such machine 10. At least one upper vibration limit may be programmed, and stored within, a programmed logic controller, or equivalent. 200. For example, a first upper vibration limit may comprise at least one alert upper limit that may be set at a moderate vibration level, but a level that may be of concern if the machine continues to operate at the alert upper limit for a period of time. Such an alert upper limit may be programmed to not provide annunciation until the alert upper limit is met or exceeded for a given period of time, e.g., detection of vibration levels at or above the alert upper limit vibration level and that persist for at least 30 seconds. The operator alert may be achieved by aural or visual annunciation mechanisms. For example, a warning light may be actuated and/or a warning siren or the like.

In addition, at least one interventional upper limit may be programmed and stored within the programmed logic controller for vibration levels that represent a danger to the machine. This interventional upper limit, when exceeded even once by the monitored vibration levels, may indicate automatic intervention, e.g., one or more of the following intervention steps: stopping the powered feed system; reversing the powered feed system; stopping the fragmenting rotor; reversing the fragmenting rotor; locking out the power feed system and/or fragmenting rotor; requiring operator action before resuming fragmenting. The locked-out power feed system and/or fragmenting rotor may require the operator to enter a password before normal fragmenting may resume. This ensures to the extent possible that the potentially ungrindable material has been eliminated from the fragmenting chamber before resuming operation. Alternatively, the interventional upper limit program may require vibration levels at or above the upper limit for a length of time, e.g., at least 10 seconds, before intervening.

Prior to beginning the fragmenting process for a given work period, e.g., workday or work shift, a daily baseline vibration level signal for the waste fragmenting machine may be established 300. This may be accomplished by monitoring the vibration signals emitted by the machine without any material in the fragmenting chamber.

One or more of the programmed upper limits described above in step 200 may be fixed prior to, or concurrent with the installation of the vibration detection assembly on the waste fragmenting machine and remain the same throughout the life of the assembly and/or machine. Alternatively, one or more of the upper limits may be programmed to vary from work period to work period based upon the established baseline signal, using the baseline signal essentially as a calibration mechanism. This calibration mechanism may account for vibrational differences due to environmental factors such as temperature fluctuations (ambient temperature as well as internal machine temperature), humidity, external acoustic noise, electromagnetic interference and the like. Accordingly, an increase or decrease in a work period baseline signal may result in a calibrated increase or decrease in the alert upper limit and/or interventional upper limit for the remainder of the work period, or until the baseline is re-established.

When the programming of the controller or equivalent is complete 200 and the daily baseline established, the vibration analyzer may be used to monitor for potentially ungrindable material within the fragmenting chamber 400. This is initiated by actuation of the power feed system that moves waste material into the fragmenting chamber. Inside the fragmenting chamber, the fragmenting rotor, with shearing or breaking teeth, is rotating at a high rate of speed, e.g., in the range of 1800-2500 r.p.m.

If material is fed into the fragmenting chamber that is too hard or dense to grind without damage, the shearing or breaking teeth will strike this material creating vibration levels that may exceed one or more of the vibration level upper limits programmed in step 200. The vibration analyzer monitors the machine vibrations, compares them with the programmed upper limit(s) and determines whether the monitored vibrations exceed one of the upper limit(s) 500. Specifically, the vibration detector, preferably an accelerometer, detects the vibrations and the controller compares the signals with the established limits previously programmed and stored within the controller. If one of the upper limit(s) is exceeded, then the vibration analyzer will actuate an operator alert, comprising aural and/or visual alerts, that indicate to the operator the presence of potentially ungrindable material within the fragmenting chamber of the waste fragmentation machine 600.

If, for example, the interventional upper limit discussed above is exceeded, the vibration analyzer may be programmed to intervene with at least one of the machine's components and/or systems 700. One such interventional step may be stopping the power feed system 710. Such a step may be accomplished by disengaging the motor $M_P$ driving the powered feed rotor and/or the motor $M_F$ driving the infeed conveyer as discussed above in connection with FIGS. 1 and 2. A second intervention may comprise reversing the power feed system by, e.g., reversing the motor $M_P$ and/or the motor $M_F$ to reverse the powered feed rotor and/or infeed conveyer, respectively 720. Another interventional step may comprise locking out the system to prevent further operation until affirmative action is taken by an operator 730. Such intervention may interrupt power to one or more of the motors $M_P$, $M_R$ and/or $M_F$. Subsequently, the operator may resume the system only after eliminating the ungrindable material, if any, 740 and unlocking the system by, e.g., entering the correct password into the operator interface system 750.

The above specification describes certain preferred embodiments of this invention. This specification is in no way intended to limit the scope of the claims. Other modifications, alterations, or substitutions may now suggest themselves to those skilled in the art, all of which are within the spirit and scope of the present invention. It is therefore intended that the present invention be limited only by the scope of the attached claims below:

The invention claimed is:

1. A method for minimizing impact damage to a waste fragmenting machine, comprising:

providing a waste fragmenting machine equipped to fragment a waste material, the machine comprising a fragmenting chamber, a powered fragmenting rotor rotating at high speed, the fragmenting rotor comprising: impacting rotor teeth; a power shaft; and power shaft bearing; and a power feed system, the feed system comprising an infeed conveyer and feed rotor drum to feed the waste material into the fragmenting chamber where it is impacted by the rotor teeth;

placing a vibration detector on the waste fragmenting machine, wherein the vibration detector comprises an accelerometer for detecting analog vibration signals, a transceiver for converting the signals into digital signals, and a programmable logic controller for evaluating the digital signals;

establishing a work period baseline vibration signal level for the waste fragmenting machine, prior to feeding waste material into the fragmenting chamber;

feeding waste material into the fragmenting chamber with the power feed system and initiating fragmenting;

monitoring vibration signals using the vibration detector during waste fragmenting;

evaluating the vibration signals to detect potentially ungrindable material and minimize damage to the machine;

detecting potentially ungrindable waste material within the fragmenting chamber during waste fragmenting; and alerting an operator of the machine of the presence of the potentially ungrindable waste material.

2. The method of claim 1, further comprising: establishing at least one alert upper limit for the vibration signal level; programming the at least one alert upper limit into the controller; comparing the vibration signal levels detected during fragmentation to the at least one alert upper limit; detecting vibration signals during fragmentation that have exceeded at least one alert upper limit; and alerting the operator of the presence of the potentially ungrindable material.

3. The method of claim 2, further comprising calibrating the at least one alert upper limit based upon the work period baseline vibration signal level.

4. The method of claim 2, further comprising alerting the operator after the vibration signal levels have exceeded the at least one alert upper limit for at least thirty seconds.

5. The method of claim 2, further comprising alerting the operator after the vibration signal levels have exceeded the at least one alert upper limit for at least two minutes.

6. The method of claim 2, further comprising: establishing at least one interventional upper limit; programming the at least one interventional upper limit into the controller; comparing the vibration signal levels detected during fragmentation to the at least one interventional upper limit; detecting at least one vibration signal during fragmentation that exceeds the at least one interventional upper limit; and intervening to minimize damage to the waste fragmenting machine.

7. The method of claim 6, further comprising calibrating the at least one interventional upper limit based upon the work period baseline vibration signal level.

8. The method of claim 6, wherein the intervening further comprises stopping the power feed system.

9. The method of claim 8, further comprising stopping the infeed conveyer.

10. The method of claim 9, further comprising stopping the feed rotor drum.

11. The method of claim 8, further comprising reversing the power feed system.

12. The method of claim 11, further comprising reversing the infeed conveyer.

13. The method of claim 12, further comprising reversing the feed rotor drum.

14. The method of claim 1, further comprising stopping the infeed conveyer and feed rotor drum after reversing.

15. The method of claim 8, further comprising stopping the fragmenting rotor when potentially ungrindable waste material is detected.

16. The method of claim 15, further comprising reversing the fragmenting rotor.

17. The method of claim 8, further comprising: locking out the power feed system; and requiring operator action before the power feed system may be restarted.

18. The method of claim 16, further comprising providing an operator interface system comprising a display and data entry keys on the waste fragmenting machine; and requiring the operator to enter a password before the power feeder may be restarted.

19. The method of claim 17, further comprising: providing at least one warning annunciator on the machine; and actuating the at least one warning annunciator when potentially ungrindable waste material is detected.

20. The method of claim 19, further comprising: providing warning lights on the operator interface system; and enabling the warning lights to flash when the alert vibration level is exceeded.

21. The method of claim 19, further comprising displaying a fault message on the operator interface.

22. The method of claim 19, further comprising providing audible annunciation of the detection of potentially ungrindable waste material.

23. The method of claim 22, further comprising actuating a warning siren in response to the detection of potentially ungrindable waste material.

24. A method for minimizing impact damage to a waste fragmenting machine, comprising: providing a waste fragmenting machine equipped to fragment a waste material, the machine comprising a fragmenting chamber, a powered fragmenting rotor rotating at high speed and comprising: impacting rotor teeth; a power shaft; and power shaft bearing, and a powered feed system comprising an infeed conveyer and power feed rotor drum to feed the waste material into the fragmenting chamber where it is impacted by the rotor teeth; placing a vibration detector on the waste fragmenting machine, in close proximity to the rotor shaft bearing, wherein the vibration detector comprises an accelerometer for detecting analog vibration signals, a transceiver for converting the signals into digital signals, and a programmable logic controller for evaluating the digital signals; establishing a work period baseline vibration signal level for the waste fragmenting machine, prior to feeding waste material into the fragmenting chamber; establishing at least one alert upper limit for the vibration signal level; establishing at least one interventional upper limit; monitoring vibration signals using the vibration detector during waste fragmenting; comparing the vibration signal levels detected during fragmentation to the at least one alert upper limit and the at least one interventional upper limit; detecting vibration signals during fragmentation that have exceeded at least one alert upper limit and the at least one interventional upper limit; alerting an operator of the machine of the presence of the potentially ungrindable waste material and intervening to minimize machine damage, the intervening selected from the group consisting of stopping the infeed conveyer, stopping the feed rotor drum, reversing the infeed conveyer, reversing the feed rotor, stopping the fragmenting rotor, reversing the fragmenting rotor, locking out the power feed system, and requiring operator action before the power feed system may be restarted.

* * * * *